United States Patent [19]

Thomas, deceased et al.

[11] Patent Number: 4,932,641

[45] Date of Patent: Jun. 12, 1990

[54] VARIABLE FORCE EXERTING CLAMP ASSEMBLY HAVING A VARIABLE CLAMPING AREA

[76] Inventors: Michael D. Thomas, deceased, late of Arab; by Ellen M. Thomas, administratrix, Rte. 6, Box 880, Arab, both of Ala. 35016

[21] Appl. No.: 401,045

[22] Filed: Aug. 29, 1989

Related U.S. Application Data

[63] Continuation-in-part of Ser. No. 160,290, Jan. 2, 1988, Pat. No. 4,861,009.

[51] Int. Cl.[5] ..... B25B 1/20

[52] U.S. Cl. ..... 269/43; 269/46; 269/131; 269/254 R

[58] Field of Search ..... 269/43, 41, 130–132, 269/254 R, 203, 204, 166, 167, 108, 46; 254/29 A; 24/146, 300, 301, 140, 68 R, 68 CD, 68 D, 459, 465; 410/96, 97

[56] References Cited

U.S. PATENT DOCUMENTS

| | | | |
|---|---|---|---|
| 1,743,811 | 1/1930 | Eull et al. | 254/29 A |
| 1,751,823 | 3/1930 | Lompert | 254/29 A |
| 2,264,794 | 12/1941 | Gunderson | 254/29 A |
| 2,328,474 | 8/1943 | Lewis | 24/300 |
| 2,372,967 | 4/1945 | Martin | 410/97 |
| 2,896,296 | 7/1959 | Huber | 24/68 D |
| 2,919,946 | 1/1960 | Miener | 24/301 |
| 3,076,646 | 2/1963 | Harling | 269/131 |
| 3,173,539 | 3/1965 | Looker | 410/97 |
| 3,186,704 | 6/1965 | McClaskey et al. | 269/254 |
| 3,961,585 | 6/1976 | Brewer | 410/97 |
| 4,377,886 | 3/1983 | Golden | 24/68 CD |
| 4,572,491 | 2/1986 | Forrer | 269/131 |

*Primary Examiner*—Robert C. Watson
*Attorney, Agent, or Firm*—C. A. Phillips

[57] ABSTRACT

A variable force exerting clamp assembly having a variable clamping area. A stretchable strap which deforms or "thins" to a smaller width in response to stretching is provided with a first work-engaging clamp secured to one end thereof and a second movable clamp which is slidable between the ends of the strap. The clamps are disposed for engaging a workpiece or workpieces between each other or for securing a pair of members together, and tension is applied until the strap is stretched to exert the desired force on the members, whereby, upon release of the tensional force, the strap tends to assume its original configuration, and the second clamp exerts a clamping force on the strap responsive to the strap expanding to its original width.

16 Claims, 5 Drawing Sheets

VARIABLE FORCE EXERTING CLAMP ASSEMBLY HAVING A VARIABLE CLAMPING AREA

CROSS REFERENCE OF RELATED APPLICATION

This application is a continuation-in-part of patent application Ser. No. 07/160,290, filed Jan. 2, 1988 now U.S. Pat. No. 4,861,009.

TECHNICAL FIELD

This invention relates generally to a clamp and more particularly to an elastic member having clamping elements thereon for gripped engagement of an assembly or element therebetween responsive to stretching of the elastic member.

BACKGROUND OF THE INVENTION

In the art of woodworking, it is sometimes necessary to clamp a pair of elements together for assembly thereof, such as by gluing, etc. Typically, the clamps are comprised of a pair of long bars joined by threaded shafts which must be rotated in threaded openings in the bars to adjust the distance between the bars. Such devices are usually very heavy or bulky in order to withstand the forces applied to them and also are usually very expensive because of the machining necessary to thread the shafts and openings. Additionally, large handles must also be machined and secured to the ends of the threaded shafts in order to rotate the shafts.

Other types of clamping devices are found in U.S. Pat. No. 4,042,264, issued Aug. 16, 1977, and U.S. Pat. No. 4,257,584, issued Mar. 24, 1981, which include a long rigid bar or rod having a stationary member thereon and a slidable member which is slid or moved along the rod for engaging the workpiece between the stationary member and the movable member. Locking means in the form of a wedge which is forced between the rod and movable member is provided in one device (U.S. Pat. No. 4,042,264), and locking is provided in U.S. Pat. No. 4,257,584 by a threaded shaft rotatable by a ratchet wrench.

As can be seen, these devices are bulky and expensive to manufacture. Additionally, because of their bulky size, the devices can be of only limited use in confined areas. In contrast, applicant has provided a clamping assembly which is compact and not bulky while also being relatively inexpensive to manufacture. To this end, applicant's structure includes a stretchable flexible strap having a work engaging member, such as a hook, rigidly secured at one end thereof and a second work engaging member or clamp slidably carried on the strap for engaging a workpiece or a pair of members to be retained in attached relation. The principles of the invention utilize the elasticity and deformability of the strap to provide the clamping and locking force.

An adjustable clamp using a flexible extension element is disclosed in U.S. Pat. No. 3,076,646, issued Feb. 5, 1963. However, the device of this invention, while using a flexible tension member to apply the clamping force to the faces of a pair of clamp jaws, also requires a reel mounted on a carrier which is reciprocally mounted on a frame. One end of the flexible element is secured to the reel so that it may be wound on the reel while the other end is secured to a clamp jaw. The device does not utilize the ability of a flexible deformable element which, in returning to its original configuration, provides a clamping force, as does applicant.

In addition to using the clamping assembly of the present invention in woodworking, the invention may be used for other purposes. One additional use, for example, can be found in securing a cover, such as a tarpaulin, over materials which one may desired to cover for protection from the elements, etc. Some such materials may be lumber or stock which is stacked in lumber yards, etc., boats carried on boat trailers, or goods and materials carried on trucks.

In the latter case, by way of example, the truck may be provided with a trailer having a bed on which the goods and/or materials are carried. Typically, such trailer beds include a single long rail or a series of short rails mounted on the sides of the trailer bed along the length thereof. The stretchable strap of the clamping assembly of the present invention may then be used to secure the cover or tarpaulin over the goods carried on the trailer bed by engaging eyelets in the tarpaulin and by being secured to the rails by the clamping member instead of having to be tied.

Bungee cords typically have been used for such tie-down operations; however, the use of bungee cords require that a large number of cords of different lengths be available so that an individual may secure loads of different heights. The working length of applicant's strap is variable, thus eliminating the need for a large inventory to be carried by the operator.

SUMMARY OF THE INVENTION

A variable force exerting clamp assembly having a variable clamping area in which a flexible, stretchable, deformable band is used to apply a holding force to a workpiece and which uses its ability to return to its original configuration responsive to deformation thereof to apply a locking or clamping force on the workpiece. The device includes a flexible, stretchable, deformable band having a first clamping member secured at one end thereof and a slidable second clamping member carried thereon. The clamping members are disposed for retaining a workpiece or workpieces therebetween or for engaging a pair of members for secured relation therebetween. The slidable member is provided with a clamping element in biased relation therewith which exerts a force on the strap as it is deformed because of a tension or stretching force applied thereto. Responsive to release of the tension force, the strap tends to assume its original position and applies a frictional force on the movable clamping member for retention thereof in the clamped position.

DESCRIPTION OF THE PREFERRED EMBODIMENT

Figure 1:
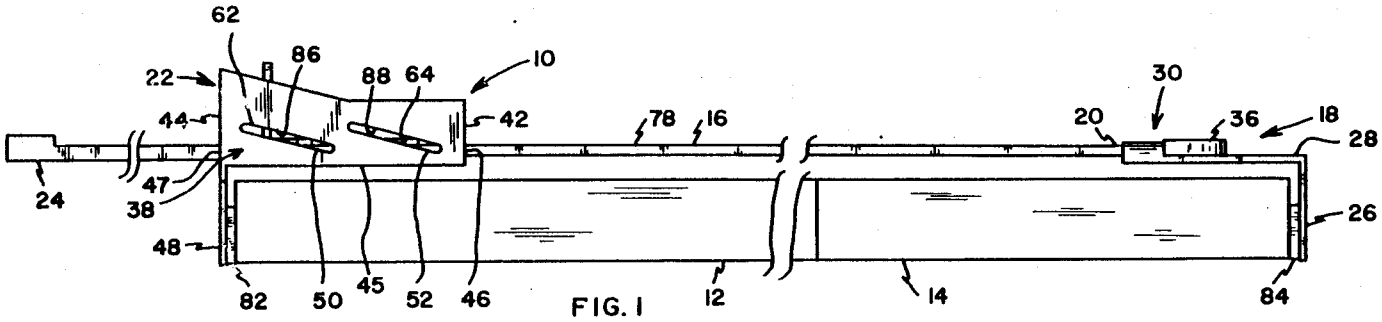
FIG. 1 is an elevational view of the clamping apparatus of the present invention illustrating a stretchable strap having a permanently affixed clamping member at one end thereof and a second clamping member carried on the strap for movable, clamping relation therewith. A pair of elements is shown to be clamped together by the clamping apparatus.

As seen in FIG. 1, a clamping device 10 is positioned to hold a pair of elements 12 and 14 in clamped relation. Clamping assembly 10 includes a stretchable strap 16 having a fixed clamping or work-engaging member 18 rigidly secured to the end 20 thereof and disposed in engaged relation with element 14. A second or movable clamp 22 is slidably mounted on the strap intermediate the distal end 24 and end 20.

Figure 2:
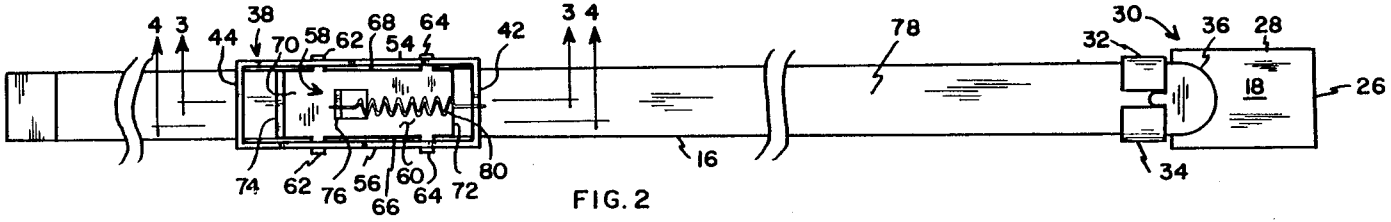
FIG. 2 is a plan view of the clamp assembly of FIG. 1.

The first clamping or work-engaging member 18 includes a downwardly depending work-engaging end portion 26, an intermediate horizontally extending portion 28, and an end 30 which includes a pair of ears 32 and 34 (FIG. 2) disposed in crimped relation adjacent a raised portion 36 of the end 20 of the strap for secured relation between the strap and work-engaging member 18.

Movable clamp assembly 22 includes a frame or retaining member 38 having upstanding forward and rearward ends 42 and 44 and an intermediate horizontal section 45. An opening 46 is provided in end 42 and a similar opening 47 is provided in end 44 through which strap 16 extends, and end 44 further includes a downwardly depending work engaging portion 48. A pair of angled slots 50 and 52 is provided in each side 54 and 56 of member 38.

Figure 5:
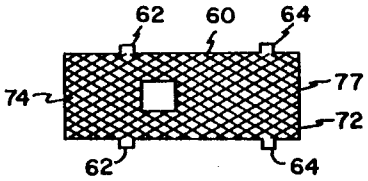
FIG. 5 is a sectional view taken along line 5—5 of FIG. 4 illustrating the bottom textured surface of the frictional clamping member.
Figure 4:
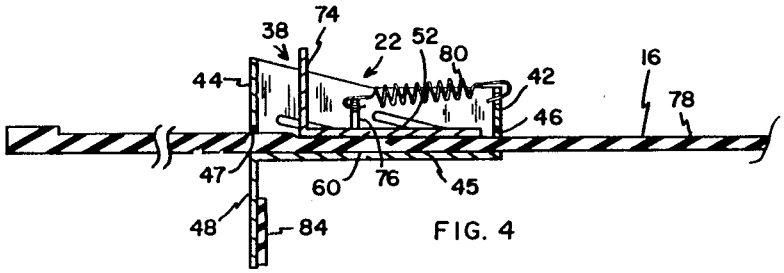
FIG. 4 is a sectional view taken along line 4—4 of FIG. 2 and illustrates the clamp assembly in the clamped position.
Figure 6:
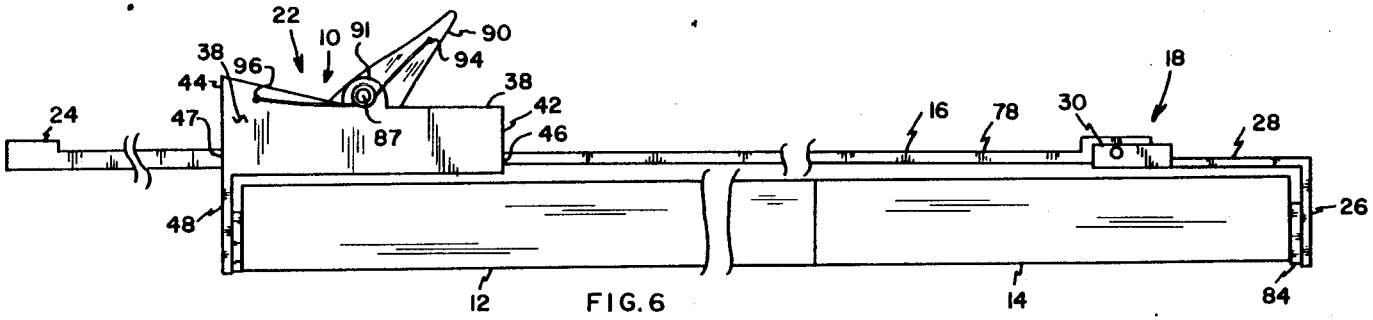
FIG. 6 is an elevational view of an alternate embodiment of the clamp assembly of the present invention.
Figure 7:
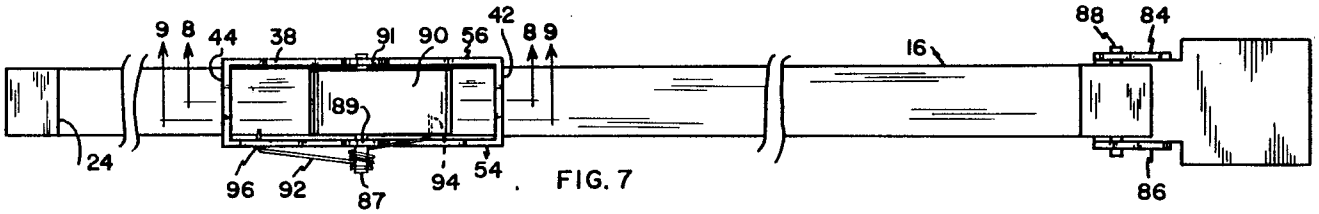
FIG. 7 is a plan view of the clamp assembly of FIG. 6.
Figure 3:
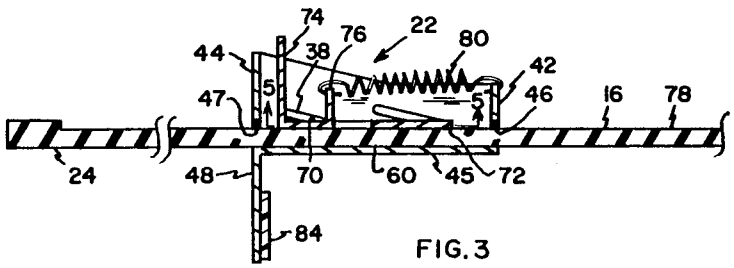
FIG. 3 is a sectional view taken along line 3—3 of FIG. 2 but illustrates the clamping assembly in the unclamped position.
Figure 9:
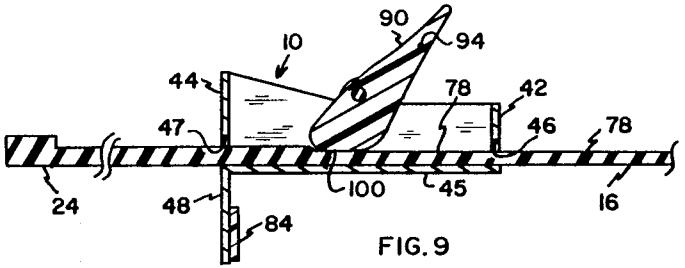
FIG. 9 is a sectional view taken along line 9—9 of FIG. 7 illustrating the clamping assembly in the unclamped position.
Figure 8:
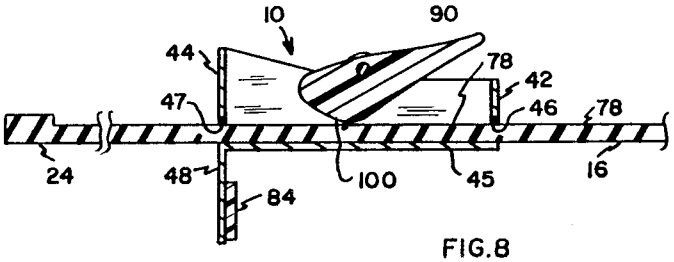
FIG. 8 is a sectional view taken along line 8—8 of FIG. 7 illustrating the clamping assembly in the unclamped position.

To provide the clamping force to the strap, a clamping member 58 (FIG. 2) is slidably mounted in retaining member 38. Clamping member 58 includes a horizontally extending portion 60 having a pair of protrusions or ears 62 and 64 extending from each side 66 and 68 intermediate ends 70 and 72 thereof. The ears extend into the angled slots 50 and 52 of retaining member 38 for slidable movement therein. Member 58 further includes an upstanding portion 74 at the end 70 thereof and a second smaller upstanding portion 76 intermediate ends 70 and 72 of member 58. The underside 77 of horizontally extending portion 60 may be textured (FIG. 5) to increase the gripping relation of member 58 and the upper surface 78 of strap 16 (FIG. 9). A spring 80 is secured in biased relation between end 42 of retaining member 38 and upstanding portion 76 of member 58.

In operation, the elements to be clamped, elements 12 and 14, are brought together and retained between member 18 and clamp assembly 22. It will be noted that the interior surfaces of depending portions 26 and 48 of members 18 and 22 are covered with a protective material 82 and 84, respectively, to prevent marring or scratching of the surfaces of the elements 12 and 14 to be clamped. Once the elements to be clamped are positioned between the clamping members, clamping assembly 22 is held by hand and strap 16 is pulled through openings 46 and 47 until the desired compressive force is reached between the elements to be clamped. As the strap is stretched and lengthened, its thickness is reduced, thus allowing portion 60 of member 58 to move forward and downward, thus reducing the space between horizontal portion 60 of member 58 and member 45 and retaining the strap in its elongated condition between these members. Upon releasing the applied tension to the belt, the underside 77 of the clamping member 58 remains in frictional contact with the upper surface 78 of the strap. The strap, because of its elasticity, tends to assume its previous undeformed configuration and exerts an upward, forward force on the clamping member which forces the ears 62 and 64 upwardly against the upper surfaces 82 and 84 of the slots in binding relation therewith. To release this binding force, the operator merely engages upstanding end 74 of slidable member 58 for rearward movement thereof which moves the member rearwardly and upwardly in grooves 50 and 52 against the bias of the spring to release the engagement between member 58 and strap 16.

FIGS. 6–9 illustrate another embodiment of the present invention wherein like numerals refer to like parts. The clamp assembly 10 includes strap 16 having the fixed, work-engaging member 26 rigidly secured to the end 20 thereof and disposed in engagement with element 14. The second or movable clamp assembly 22 is slidably mounted on the strap intermediate the distal end 24 and end 20.

In this embodiment, work-engaging member 18 includes downwardly depending, work-engaging end portion 26, an intermediate, horizontally extending portion 28, and an end 30 which includes a pair of upstanding sides 84 and 86 disposed in spaced relation. A pin 88 extends through strap 16 and is secured to sides 84 and 86 to secure member 18 to strap 16.

Movable clamp assembly 22 includes frame or retaining member 38 having upstanding forward and rearward ends 42 and 44, respectively. Opening 46 is provided in end 42, and a similar opening 47 is provided in end 47 to receive strap 16. End 44 further includes downwardly depending work-engaging portion 48. A lever 90 is pivotally mounted by a pin 87 which extends between raised arcuate portions 89 and 91 of sides 54 and 56 of retaining member 38. A spring 92 is secured in an opening 94 of lever 90 and in an opening 96 in side 56 of retaining member 38 for biasing the end 98 of lever 90 upwardly and a lower cam surface 100 of lever 90 (FIGS. 8 and 9) downwardly in engagement with the upper surface 78 of strap 16. The surface 100 may be roughened to enhance the gripping force between the lever and the strap.

In the operation of this embodiment, the elements 12 and 14 which are to be clamped are brought together in the manner described above. Once the elements to be clamped are positioned between the clamping members, strap 16 is pulled through the openings 46 and 47 until the desired compressive force is reached between the elements to be clamped. The strap is released and the spring 92 exerts an upward force on end 98 of lever 90, and frictional contact is maintained between upper surface 78 of the strap and surface 100 of lever 90. In attempting to assume its previous undeformed configuration, the belt tends to swell or enlarge in width which exerts an upward binding force against surface 100 of lever 90. To release this binding force, the operator merely depresses end 98 of lever 90 for disengagement of surface 100 of lever 90 with the strap.

Figure 10:
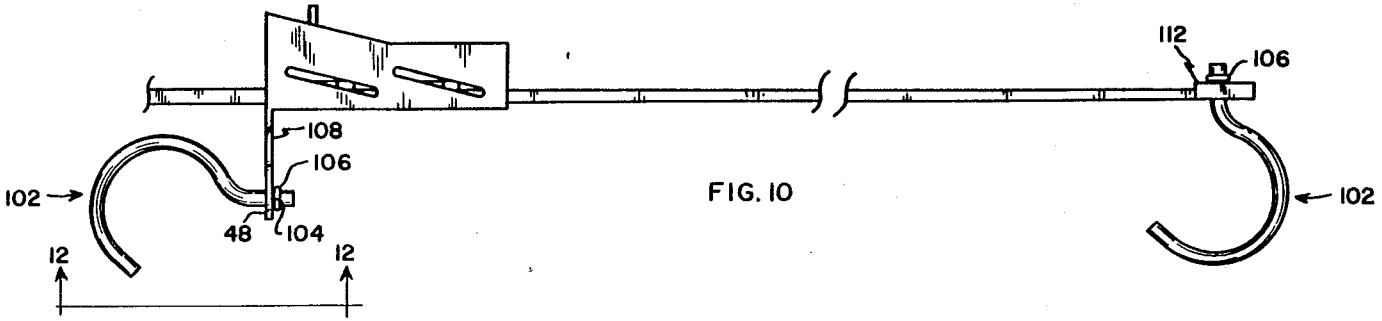
FIGS. 10 and 11 are elevational views of the clamp assembly of the present invention and illustrates a hook arrangement for retaining workpieces in the clamp assembly of the present invention.
Figure 11:
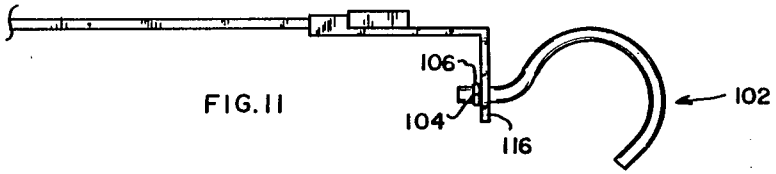
Figure 12:
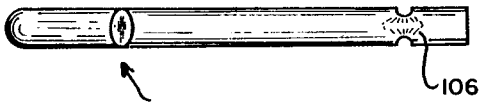
FIG. 12 is an elevational view as seen along line 12—12 of FIG. 10.

FIGS. 10–12 illustrate other types of end clamping members for use with circular or semi-circular members, such as a chair or table legs, etc. As seen in FIG. 10, a hook 102 is secured in an opening 104 of downwardly depending member 48 of retaining member 38. The hook includes a shoulder 106 which engages a back side surface 108 for releasable retention of the hook in the opening. The hook is merely inserted through the opening until shoulder 106 abuts against the surface. As can be further seen in FIGS. 10 and 12, the end member 18 may or may not be used as a clamping member. If desired, as seen in FIG. 10, end member 18 may be replaced by hook 102 which is inserted in an opening 110 at the end 20 of strap 16, with shoulder 106 engaging an upper end surface 112 of the strap. Or, if desired, the hook 102 may be inserted in an opening 114 of downwardly depending member 26 with shoulder 106 abutting an inner surface 116 of member 16.

Figure 13:
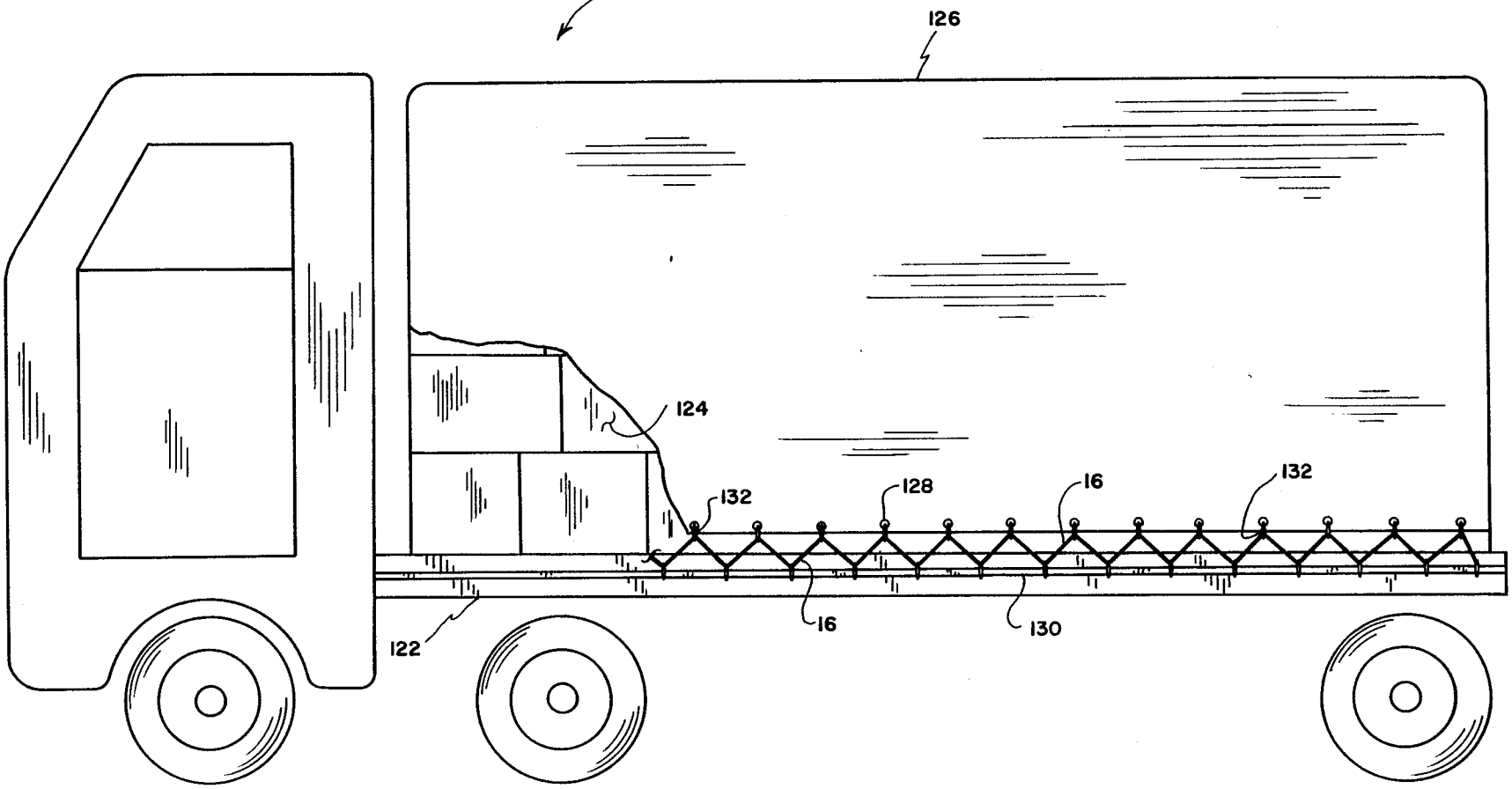
FIG. 13 is an elevational view of a truck having a tarpaulin covering materials carried on the bed of a truck. The clamp assembly of the present invention is shown securing the tarpaulin to the bed of the truck.

A further embodiment of the present invention is disclosed in FIGS. 13–16 wherein straps are used to secure a tarpaulin to a truck. As seen in FIG. 13, a truck 120 is shown to have a trailer 122 having goods 124 carried thereon and covered by a tarpaulin 126 for protection of the goods. To secure the tarpaulin over the goods, strap 16 is stretched and secured between eyelets 128 provided on the tarpaulin and a rod 130 extending along each side of the trailer bed. The eyelets may be of the type which extend through the tarpaulin or may be ring-like members sewn to the tarpaulin. Other types of securing devices may be provided on the truck instead of rods 130. Eyelets may be provided on ears protruding from the bed of the truck, or, if desired, eyelets may be provided along a member secured along the length of the bed of the truck.

To secure the strap in the desired position, a plurality of hooks 132 is provided. The hooks engage the eyelets 128 of the tarpaulin and the rod 130 of the truck, as shown in FIG. 13. Hooks may also be used to secure the strap to the rod or other securing members provided on the truck bed. Or, if desired, the straps may be simply wrapped around the rod.

Figure 14:
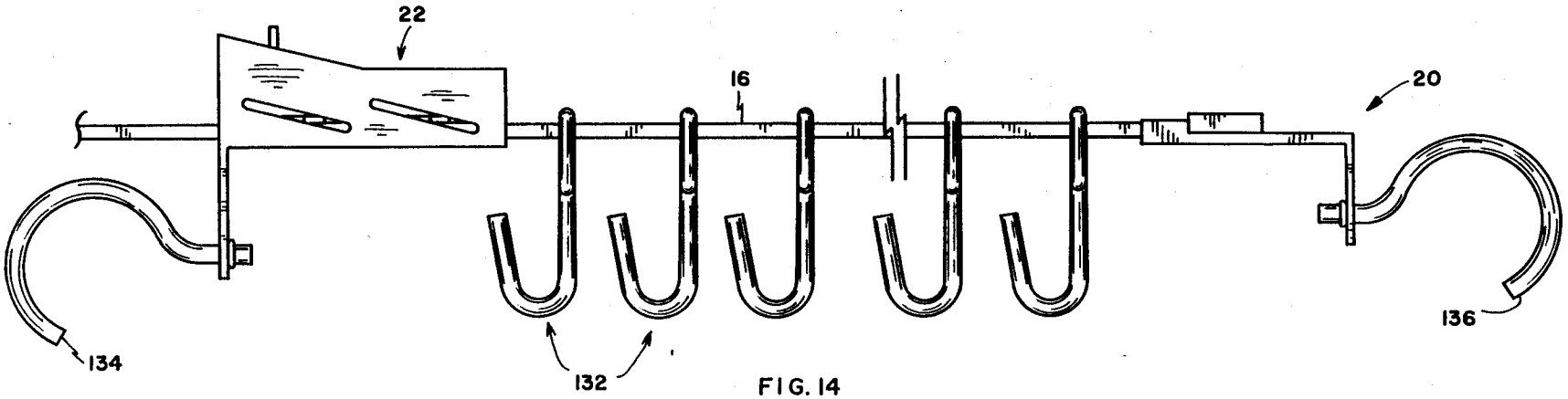
FIG. 14 is an elevational view of the clamp assembly used in the embodiment illustrated in FIG. 13.
Figure 16:
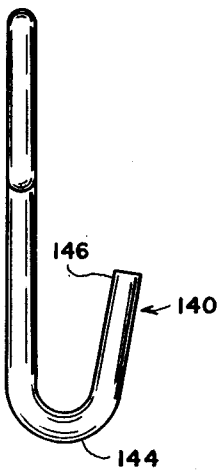
FIG. 16 is a side elevational view of the hook of FIG. 15.
Figure 15:
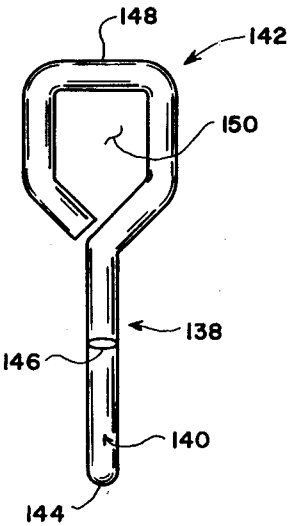
FIG. 15 is a front elevational view of a hook used in the embodiment illustrated in FIG. 13.

FIG. 14 is a side elevational view, similar to FIG. 10, of the strap and hook assembly prior to use on the truck. As seen in FIG. 14, the hooks 132 are loosely assembled along strap 16 between end hook members 134 and 136 which are secured, respectively, to clamp 22 and the distal end 20 of strap 16. Hook members 134 and 135 may have any of many configurations including the configurations as shown in FIGS. 15 and 16. To secure the strap between the eyelets of the tarpaulin and the rod on the truck bed, it is only necessary to attach end hook 136 to the rod or other member of the truck bed for secured relation therewith and to attach the hooks 132 alternately between eyelets 128 and rod 130 while stretching strap 16. When the desired tension of strap 16 is reached, hook member 134 is rigidly attached to rod 130, and slidable member 58 of member 22 is released for secured relation of the clamping member to strap 16 and to the truck bed, thus securing the tarpaulin tightly to the truck bed.

FIGS. 15 and 16 illustrate a hook 132 which may be used in conjunction with this tie-down embodiment of the present invention. The hooks are loosely placed along strap 16 and also may be used, if desired, at the end 20 of strap 16 and on member 22. Hook 132 includes a body 138 having a hook end 140 and an eyelet end 142. The hook end is provided with a curved portion 144 (FIG. 16) having a predetermined radius and an extending end portion 146 extending therefrom. The eyelet end 142 includes a substantially closed portion 148 defining a substantially rectangular eye 150 through which strap 16 extends. It is to be understood that this embodiment of the present invention is not to be limited to use with the hook shown and described in FIGS. 15 and 16 as hooks similar to those shown in FIGS. 10 and 11 and hooks having other configurations may be used.

It is to be also understood that while a single strap is shown being used in FIG. 13, the present invention is not to be so limited since one or more straps may be used, the number being used depending, of course, on the length of the tarpaulin, the length of the strap, and the length of the truck bed.

It is to be further understood that the tie-down strap of the present invention is not to be limited to use with a trailer truck as described herein as the tie-down strap may be used with other types of vehicles (boat trailers, etc.) or in other situations which require a tie-down function other than on vehicles.

I claim:

1. A variable force exerting clamp assembly having a variable clamping area, said clamp assembly disposed for retention of a first and second member in secured relation, and comprising:

an elastic stretchable strap;

a first fixed clamping member rigidly secured to a first end of said strap;

a second clamping member disposed in slidable relation on said elastic strap;

frictional clamping means carried by said second clamping member in biased relation therewith and in contactual relation with said strap, said strap disposed for deformation from a first normal configuration to a second, thinner, more elongated configuration responsive to application of a tensional force thereto, and said clamping means disposed for gripped engagement with said strap responsive to said strap returning to said first normal configuration in response to release of said tensional force;

said clamp assembly disposed for securing said first and second members together, whereby the distance between said clamping members is defined by the distance said second clamping member is moved along said strap, and the force exerted between said first and second members is determined by the amount of tensional force applied to said strap; and hook means disposed on said strap intermediate said first and second clamping members, said first clamping member disposed for secured relation with said first member, and said second clamping member disposed for secured relation with said first member for secured relation of said first and second members by said clamp assembly.

2. A clamp assembly as set forth in claim 1 wherein said hook means is a plurality of hook members carried along the length of said strap intermediate said first and second clamping members.

3. A clamp assembly as set forth in claim 2 wherein said second member is a cover sheet for covering and protecting goods carried on said first member.

4. A clamp assembly as set forth in claim 3 wherein said hook members are slidably carried on said strap.

5. A clamp assembly as set forth in claim 4 wherein said first member is a vehicle provided with attachment means on the edges thereof for secured relation of said strap therewith.

6. A clamp assembly as set forth in claim 1 wherein said frictional clamping means includes a pair of substantially parallel sides having guide means thereon, and said second clamping member includes a retaining member for slidably supporting said frictional clamping means therein, said retaining member having sides provided with complementary guide means thereon to receive said guide means of said frictional clamping means.

7. A clamp assembly as set forth in claim 6 wherein said guide means of said frictional clamping means includes a pair of spaced protrusions extending from said sides, and said complementary guide means is a pair of angled slots arranged in spaced relation in each said side of said retaining member, said angled slots having upper surfaces disposed for engaged relation by said protrusions for binding relation therebetween responsive to release of said tensional force on said strap.

8. A clamp assembly as set forth in claim 7 including a spring secured to said forward end of said retaining member and said frictional clamping means for biased relation thereof.

9. A clamp assembly as set forth in claim 8 wherein said clamping member is provided with a lower textured surface to enhance the frictional contact between said slidable member and said strap.

10. A clamp assembly as set forth in claim 9 wherein said slots are defined by upper and lower spaced surfaces, said upper surface being serrated to enhance the gripping force between said slidable member and said sides of said retaining member.

11. A clamp assembly as set forth in claim 1 wherein said second clamping member includes a retaining member for support of said frictional clamping means therein, said frictional clamping means including a lever pivotally mounted in biased relation in said retaining member, said lever including a lower arcuate surface disposed for frictional gripping engagement with the upper surface of said strap.

12. A clamp assembly as set forth in claim 11 wherein said retaining member includes a pair of spaced sides, each side including a raised arcuate surface having an opening therein, a pin extending between and secured in said openings, said lever mounted on said pin in pivotal relation.

13. A clamp assembly as set forth in claim 12 including a spring mounted in said pin and provided with a first end secured to said lever and a second end secured to said retaining member for the biased relation of said lever in said retaining member.

14. A clamp assembly as set forth in claim 2 including clasping means defined by arms secured to and extending from said clamping members.

15. A clamp assembly as set forth in claim 14 wherein said clasping means further includes a hook-like member secured to selected arms of said clamping members.

16. A clamp assembly as set forth in claim 2 including clasping means defined by a hook-like member secured to said first end of said strap.

* * * * *